US012202661B2

(12) United States Patent
Berge

(10) Patent No.: US 12,202,661 B2
(45) **Date of Patent: *Jan. 21, 2025**

(54) MOLDED DISPENSING CLOSURE WITH BIASING HINGE ASSEMBLY

(71) Applicant: Silgan White Cap LLC, Downers Grove, IL (US)

(72) Inventor: Gary Berge, Crystal Lake, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/500,547

(22) Filed: Nov. 2, 2023

(65) Prior Publication Data

US 2024/0059464 A1 Feb. 22, 2024

Related U.S. Application Data

(63) Continuation of application No. 17/504,003, filed on Oct. 18, 2021, now Pat. No. 11,840,382.

(60) Provisional application No. 63/238,479, filed on Aug. 30, 2021.

(51) Int. Cl.
*B65D 51/18* (2006.01)
*B65D 47/20* (2006.01)

(52) U.S. Cl.
CPC ..... *B65D 51/18* (2013.01); *B65D 47/2006* (2013.01); *B65D 2251/0021* (2013.01); *B65D 2251/0078* (2013.01); *B65D 2251/1066* (2013.01)

(58) Field of Classification Search
CPC ..... B65D 51/18; B65D 47/2006; B65D 2251/0021; B65D 2251/0078; B65D 2251/1066; B65D 2251/1016; B65D 47/0895
See application file for complete search history.

(56) References Cited

U.S. PATENT DOCUMENTS

| | | | |
|---|---|---|---|
| 5,228,584 | A | 7/1993 | Williams, Jr. |
| 5,894,965 | A | 4/1999 | Robbins, III et al. |
| 6,092,690 | A | 7/2000 | Bitowft et al. |
| 6,263,543 | B1 | 7/2001 | Daoud |
| 6,283,333 | B1 | 9/2001 | Knickerbocker et al. |
| 9,102,427 | B2 | 8/2015 | Hanna et al. |
| 2006/0191948 | A1 | 8/2006 | Wisniewski et al. |
| 2009/0165813 | A1 | 7/2009 | Sekine |

(Continued)

FOREIGN PATENT DOCUMENTS

JP 09-309555 12/1997

OTHER PUBLICATIONS

International Search Report and Written Opinion for International Application No. PCT/US2022/041887, dated Dec. 14, 2022, 11 pages.

*Primary Examiner* — James N Smalley

(74) *Attorney, Agent, or Firm* — Reinhart Boerner Van Deuren s.c.

(57) ABSTRACT

A closure includes a pivoting closure cap and a closure base configured to more easily align and securely pivot open without uncoupling. In various embodiments, the pivoting closure cap includes a pair of hinge assemblies including hinge pins pivotable between a closed position and an open position where the pivoting closure cap is opened for pouring. The closure base includes a pair of hinge pin receivers with a hinge pin sockets. The hinge pins located and rotatable within the sockets.

20 Claims, 12 Drawing Sheets

(56) References Cited

U.S. PATENT DOCUMENTS

| | | | |
|---|---|---|---|
| 2012/0061412 | A1 | 3/2012 | Vovan |
| 2021/0061527 | A1 | 3/2021 | Conceicao et al. |

MOLDED DISPENSING CLOSURE WITH BIASING HINGE ASSEMBLY

CROSS-REFERENCE TO RELATED PATENT APPLICATIONS

The present application is a continuation of U.S. application Ser. No. 17/504,003, filed Oct. 18, 2021, which claims the benefit and priority to U.S. Provisional Application No. 63/238,479, filed on Aug. 30, 2021, which are incorporated herein by reference in their entireties.

BACKGROUND OF THE INVENTION

The present invention relates generally to the field of closures for containers. The present invention relates specifically to a molded dispensing closure or cap with components configured for easier alignment and a more secure fit.

SUMMARY OF THE INVENTION

One embodiment of the invention relates to a closure. The closure includes a pivoting closure cap with an upper surface and a lower surface. The closure further includes a hinge assembly extending downward from the pivoting closure cap including a support member. The support member includes a top end connected to the closure cap and extending to a bottom end. The hinge assembly further includes a truncated hinge pin extending generally perpendicular to and from the lower end of the support member to a distal end and a detent rib extending upwardly from the pin toward the top end. A closure base including a hinge pin receiver having a receiver top and a receiver bottom. The receiver including an elongated hinge pin socket formed in the receiver proximate the receiver bottom and a detent groove extending from the pin socket toward the receiver top. The hinge pin is located and rotatable within the socket. The closure cap pivots relative to the closure base between a closed position in which the detent rib rests within the detent groove and an open position in which the detent rib rests outside the detent groove.

Another embodiment of the invention relates to a closure. The closure includes a pivoting closure cap with an upper surface and a lower surface. The closure further includes a pair of hinge assemblies extending downward from the pivoting closure cap and having the same rotational axis. Each hinge assembly including a support member. The support member includes a top end connected to the closure cap and extending to a bottom end. The hinge assembly further includes a truncated hinge pin extending generally perpendicular to and from the lower end of the support member to a distal end and a detent rib extending upwardly from the pin toward the top end. A closure base including an opposing pair of hinge pin receivers each having a receiver top and a receiver bottom. Each receiver including an elongated hinge pin socket formed in the receiver proximate the receiver bottom and a detent groove extending from the pin socket toward the receiver top, the hinge pins being located and rotatable within the sockets. The closure cap pivots relative to the closure base between a closed position in which the detent ribs rest within the detent grooves and an open position in which the detent ribs rest outside the detent grooves.

Another embodiment of the invention relates to a closure. The closure includes a pivoting closure cap with an upper surface and a lower surface. The closure further includes a pair of hinge assemblies extending downward from the pivoting closure cap and having the same rotational axis. Each hinge assembly including a support member. The support member includes a top end connected to the closure cap and extending to a bottom end. The hinge assembly further includes a truncated hinge pin extending generally perpendicular to and from the lower end of the support member to a distal end and a detent rib extending upwardly from the pin toward the top end. A cylindrical cap plus extending downward from the lower surface of the pivoting cap closure. A closure base including an opposing pair of hinge pin receivers each having a receiver top and a receiver bottom. Each receiver including an elongated hinge pin socket formed in the receiver proximate the receiver bottom and a detent groove extending from the pin socket toward the receiver top, the hinge pins being located and rotatable within the sockets. The closure base defining a fluid channel positioned such that the cylindrical cap plug rests within the fluid channel. A pour spout formed in the closure base, the pour spout positioned at least partially around and extending upward from the fluid channel. The closure cap pivots relative to the closure base between a closed position in which the detent ribs rest within the detent grooves and an open position in which the detent ribs rest outside the detent grooves. The pair of hinge pin receivers further include a pair of cam surfaces located at the receiver bottom and adjacent to the hinge pin sockets, the bottom end of the hinge assemblies bearing against the cam surfaces such that when the closure cap is pivoted open, the closure cap is simultaneously lifted during pivoting. The lift provided to the closure cap during pivoting lifts the cylindrical cap plug out of the fluid channel when the closure is in an open position such that a fluid can travel through the fluid channel and pour from the spout Additional features and advantages will be set forth in the detailed description which follows, and, in part, will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1A:
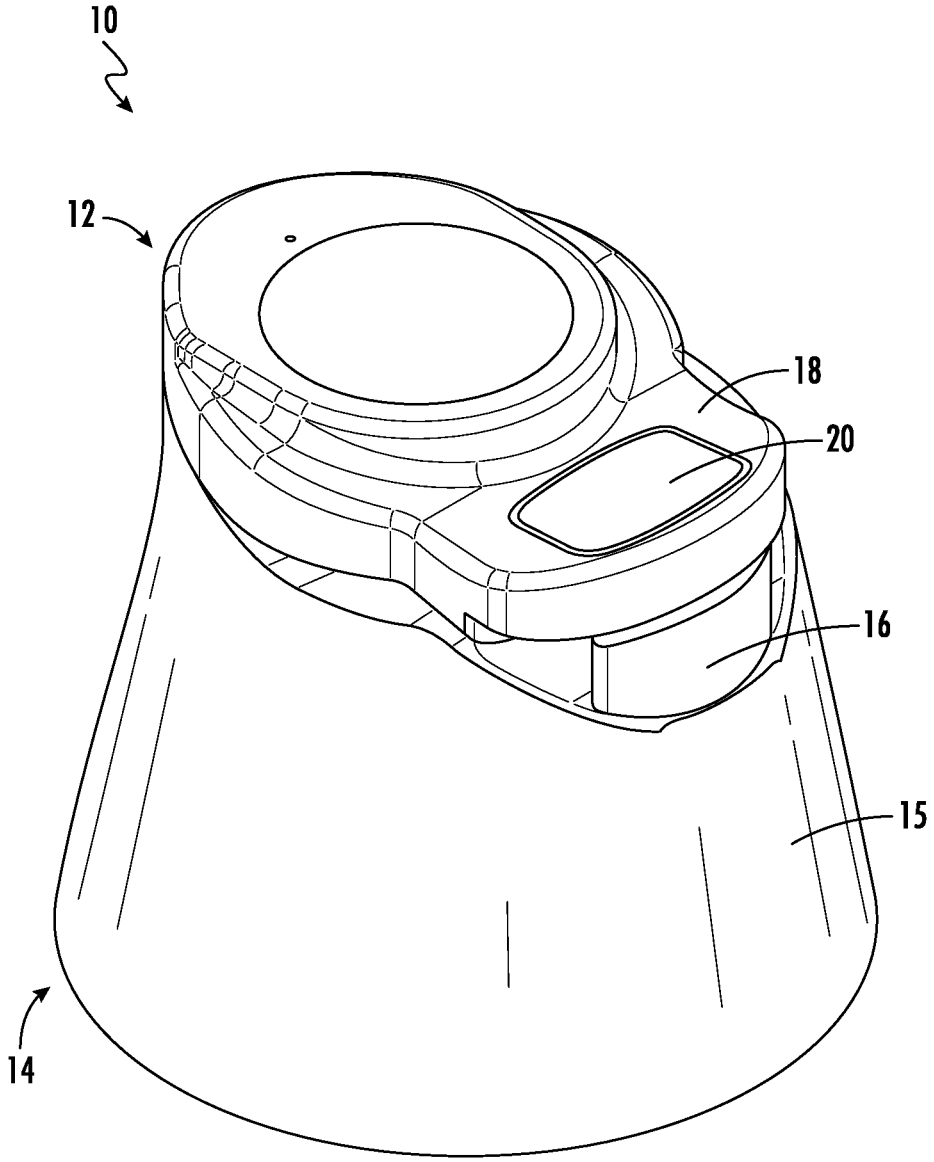
FIG. 1A is a perspective view of a closure, according to an exemplary embodiment.

Referring generally to the figures, various aspects of a closure, shown as a dispensing cap are shown. Closures and specifically dispensing closures or caps are used to enclose containers and can be coupled to the neck of containers (e.g., bottles) to aid in the dispensing of the stored liquid (e.g., water, milk, creamer). Applicant believes the closure discussed herein includes an improved structure allowing for easier alignment of the closure components and a more secure coupling between the closure components. The dispensing closure includes a pair of hinge pin receivers each with a pair of pin guides shaped to direct the opposing par of hinge assemblies of the pivoting closure cap into a pair of pin sockets in the closure base. The hinge pin receivers further include a receiver top to act as a ramp and detent groove above the pin receiver aiding in alignment and stability during pivoting. In contrast to the closure discussed herein, other dispensing closures frequently use an indentation in the base to receive the pin. Further, previous closures have problems with alignment because of shrinking and distortion associated with molding that are avoided by using the hinge pin receiver discussed herein.

Referring to FIGS. 1-4, a closure, such as a dispensing cap 10, is shown according to an exemplary embodiment. In general, dispensing cap 10 includes a pivoting closure cap 12 and a closure base 14. Closure base 14 includes a wall 15 extending from a lower or bottom edge 23 to an upper or top edge 25. Wall 15 and closure base 14 have a generally inward taper from lower edge 23 to upper edge 25. Closure base 14 further includes a generally vertical inner surface 39 (i.e., parallel to longitudinal axis 21 by plus or minus 10°) and a generally horizontal (i.e., generally perpendicular to inner surface 39 by plus or minus 10°), upward facing surface 40. A pair of hinge pin receivers 26*a*, 26*b* are positioned along generally vertical inner surface 39.

Pivoting closure cap 12 includes an upper surface 18 and a lower surface 49. Lower surface 49 faces closure base 14 and upper surface 18 is outward facing. Pivoting closure cap 12 further includes a first hinge assembly 22*a* and a second hinge assembly 22*b* extending downward from the pivoting closure cap 12. First and second hinge assembly 22*a*, 22*b* each include a support member 24 including a top end 27 connected to the cap and extending to a bottom end 29, a truncated hinge pin 70 extending generally perpendicular to and from the lower end of the support member to a distal end and a detent rib 66 extending upwardly from the truncated hinge pin 70 toward the top end 27 of support member 24.

Upper surface 18 includes a push pad 20. As will be discussed in greater detail below, when push pad 20 is pressed, hinge assemblies 22*a* and 22*b* and pivoting closure cap 12 are configured to pivot. Pivoting closure cap 12 pivots from a closed position to an open position when a force is applied to push pad 20. The force has a magnitude to move the detent rib 66 from within the detent groove 54. As the closure cap 12 pivots, the closure cap 12 simultaneously lifts and opens the dispensing cap 10 for use, so a liquid can be poured.

Figure 1B:
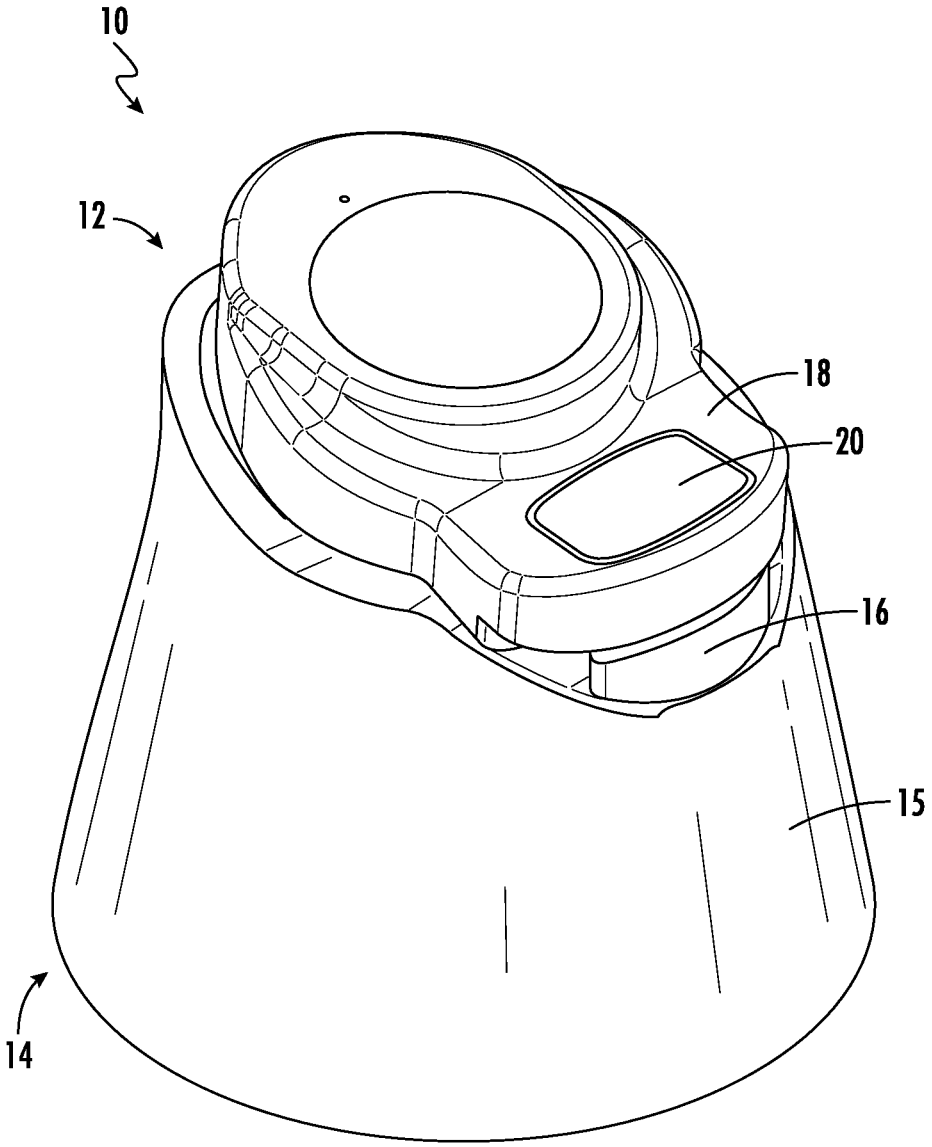
FIG. 1B is a perspective view of the closure of FIG. 1, showing the pivoting closure cap in a pivoted position, according to an exemplary embodiment.
Figure 2A:
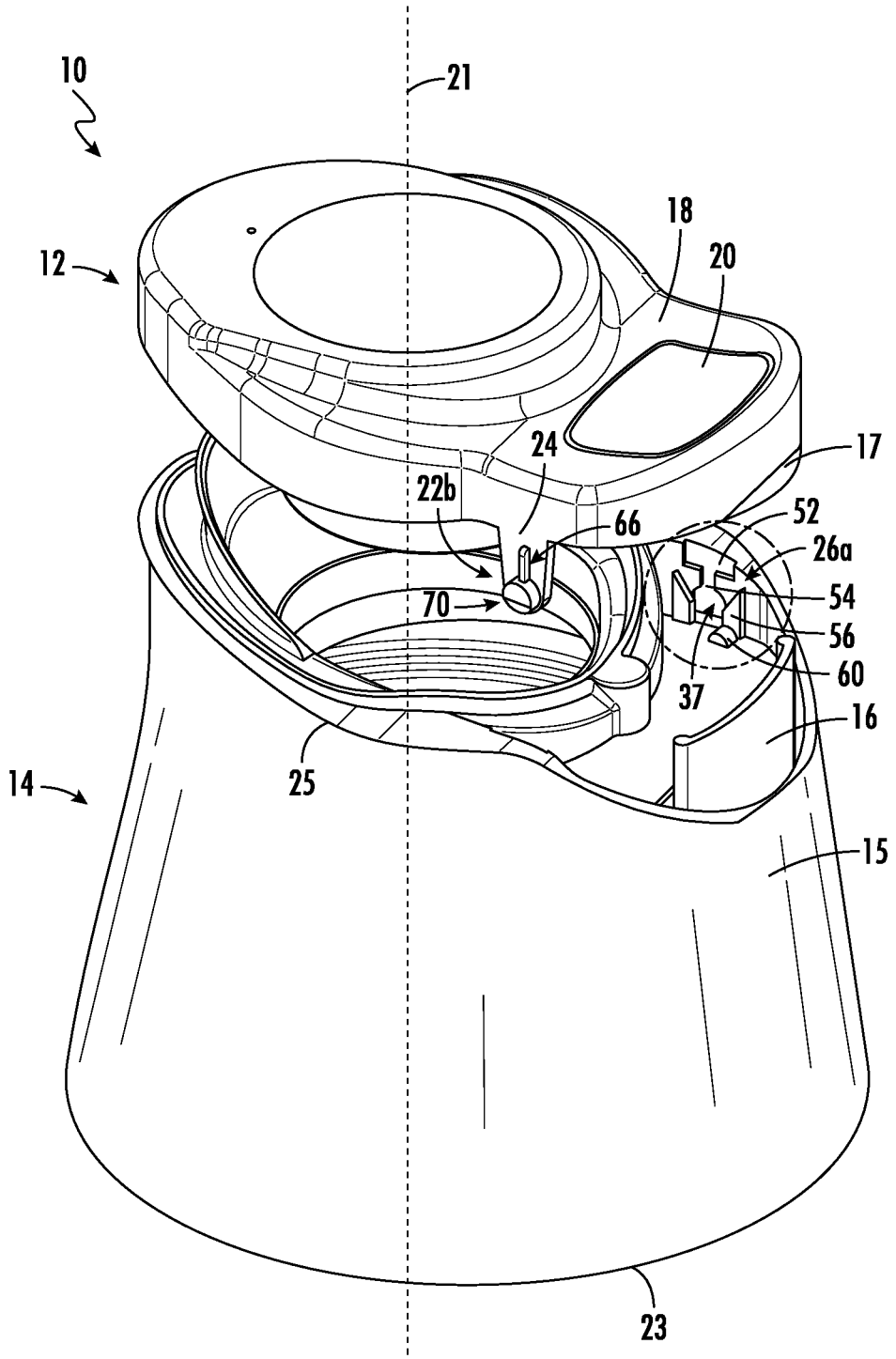
FIG. 2A is an exploded perspective view of the closure of FIG. 1, according to an exemplary embodiment.
Figure 2B:
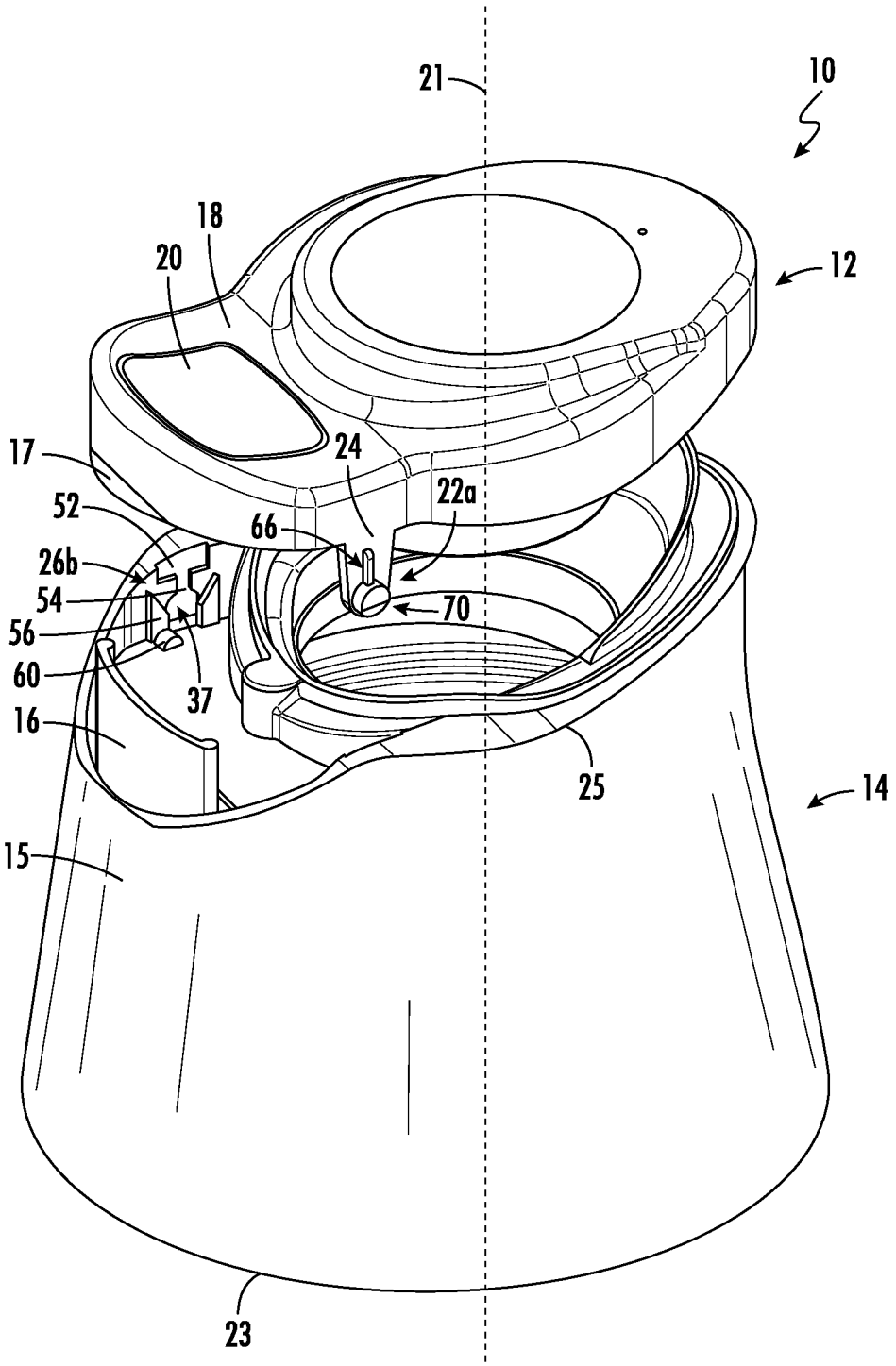
FIG. 2B is an exploded perspective view of the closure rotated 180° clockwise from FIG. 2A, according to an exemplary embodiment.

Referring to FIG. 2A an exploded perspective view of the closure of FIG. 1 is shown, with FIG. 2B showing an exploded perspective view of the closure rotated 180° clockwise from FIG. 2A. Closure cap 12 further includes a lip or protrusion 17 extending outward from closure cap 12 and configured to engage with closure base 14 when dispensing cap 10 is pivoted into a fully open position. Lip 17 engages with a corresponding protrusion 35 (see e.g., FIG. 3A) extending upward from wall 15 of closure base 14.

Figure 3A:
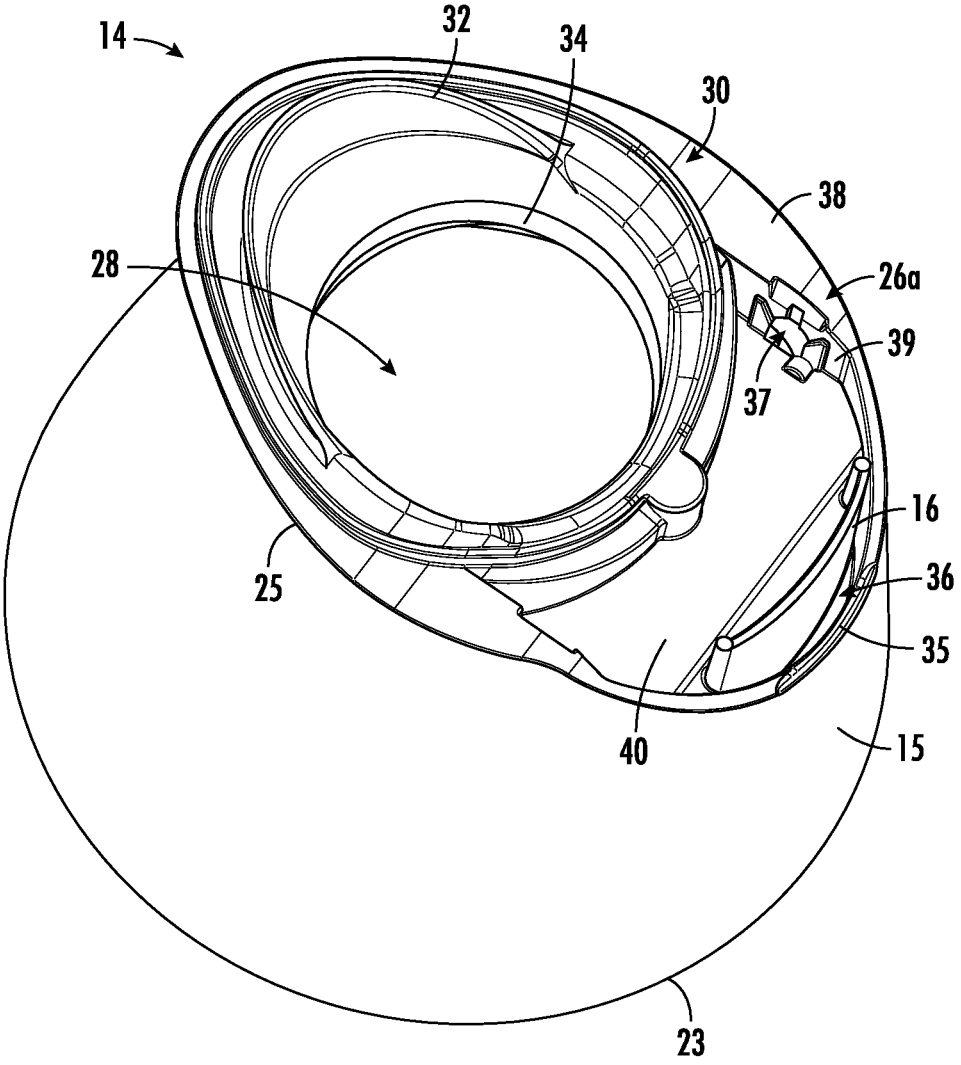
FIG. 3A is a top perspective view of a closure base of the closure of FIG. 1, according to an exemplary embodiment.
Figure 3B:
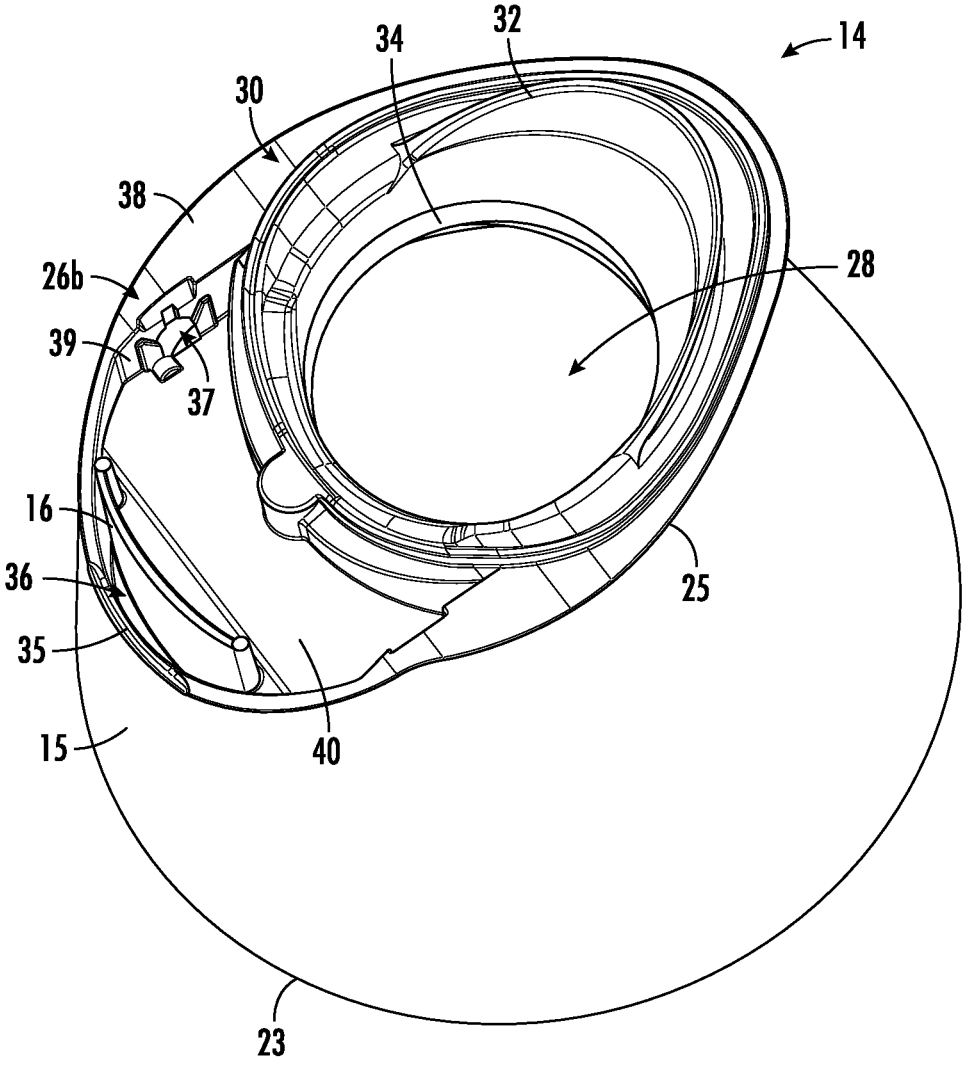
FIG. 3B is a top perspective view of the closure rotated 180° clockwise from FIG. 3A, according to an exemplary embodiment.

Referring to FIGS. 3A-3B, closure base 14 includes an anti-pry feature shown as a barrier wall 16. Barrier wall 16 is positioned in a recess 36 between wall 15 and the hinge pin receivers 26*a*, 26*b* adjacent to the rear of closure base 14. When push pad 20 is pressed, and pivoting closure cap 12 is pivoted to a maximum angle, lip 17 is positioned within recess 36 and engaged with protrusion 35. The engagement between lip 17 and protrusion 35 holds closure cap 12 in the fully open position and creates resistance to closure cap 12 pivoting from the open position to the closed position.

Closure base 14 includes a fluid channel 28 centered on a longitudinal axis 21 and includes an inner surface 34. Fluid channel 28 is a part of the dispensing system 30. Dispensing system 30 includes a lip or pour spout 32. Pour spout 32 is formed in the closure base 14 and positioned at least partially around and extending upward and away from fluid channel 28 at an angle. When connected to a container (e.g., a bottle), a user can pour a liquid (e.g., water, milk, creamer) out through fluid channel 28 and over pour spout 32 into a different container or cup when dispensing cap 10 is pivoted and lifted into an open position.

Barrier wall 16 is positioned between fluid channel 28 and hinge pin receivers 26*a*, 26*b* and helps to prevent pivoting closure cap 12 and closure base 14 from being physically pried apart when in a coupled or assembled position. Closure base 14 includes an upward facing surface 38 of wall 15. In some locations, upward facing surface 38 is perpendicular to generally vertical inner surface 39. In other areas, upward facing surface 38 may instead be partially curved as it angles downward toward the rear of closure base 14 where barrier wall 16 is located.

Figure 4A:
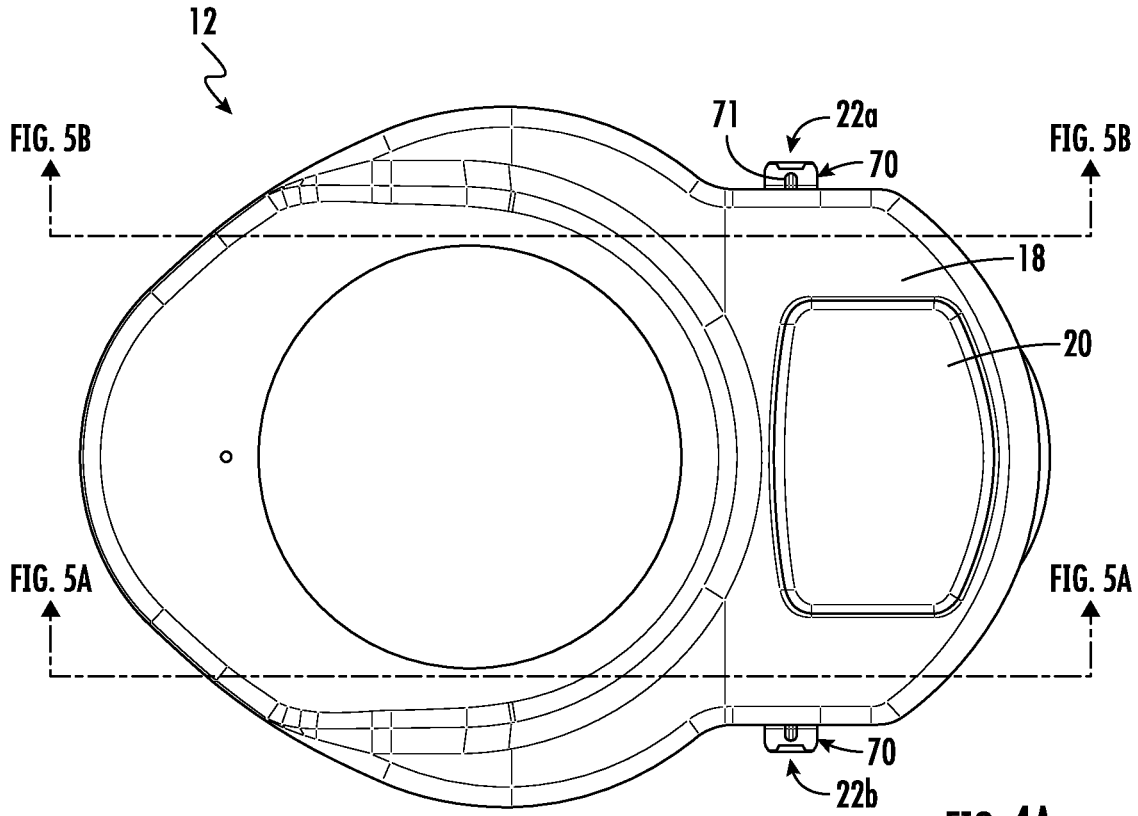
FIG. 4A is a top view of a pivoting closure cap of the closure of FIG. 1, according to an exemplary embodiment.
Figure 4B:
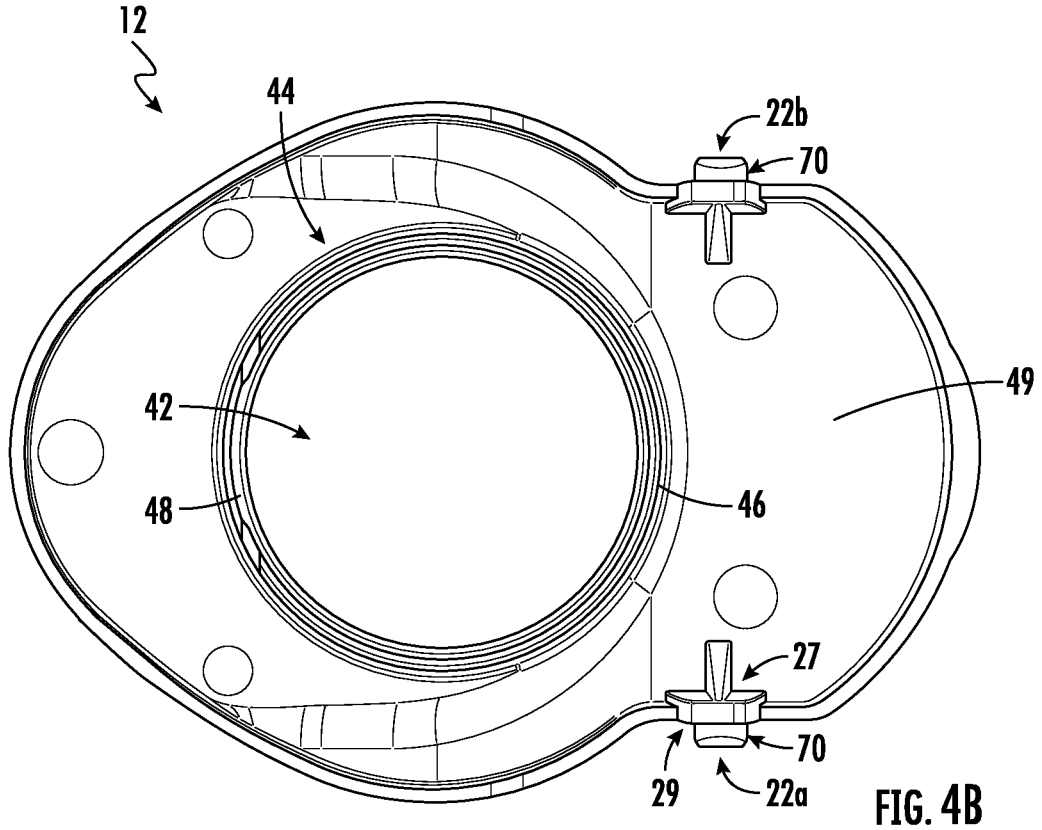
FIG. 4B is a bottom view of a pivoting closure cap of the closure of FIG. 1, according to an exemplary embodiment.

Referring to FIGS. 4A-4B, a top and a bottom view of a pivoting closure cap 12 is shown. Pivoting closure cap 12 further includes a cylindrical cap plug 44 extending toward closure base 14 from lower surface 49. Cylindrical cap plug 44 defines an opening 42 and is centered on longitudinal axis 21 and includes an exterior or outer surface 46. At a bottom, front portion of cylindrical cap plus 44 a projection 48 is configured to guide cylindrical cap plug 44 as it is received within fluid channel 28 of closure base 14 such that outer surface 46 engages with inner surface 34 of the fluid channel 28. The lift experienced by closure cap 12 during pivoting lifts or pulls the cylindrical cap plug 44 out of the fluid channel 28 such that when the closure cap 12 is in the open position, cylindrical cap plug 44 no longer blocks the flow of fluid out of dispensing cap 10.

Pivoting closure cap 12 further includes a pair of rear segments 50 of hinge assemblies 22*a*, 22*b* having a generally triangular shape and extending from a point adjacent to truncated hinge pin 70 to a base at lower surface 49. Rear segment 50 provides further support for support members 24 of hinge assemblies 22*a* and 22*b*.

Figure 5A:
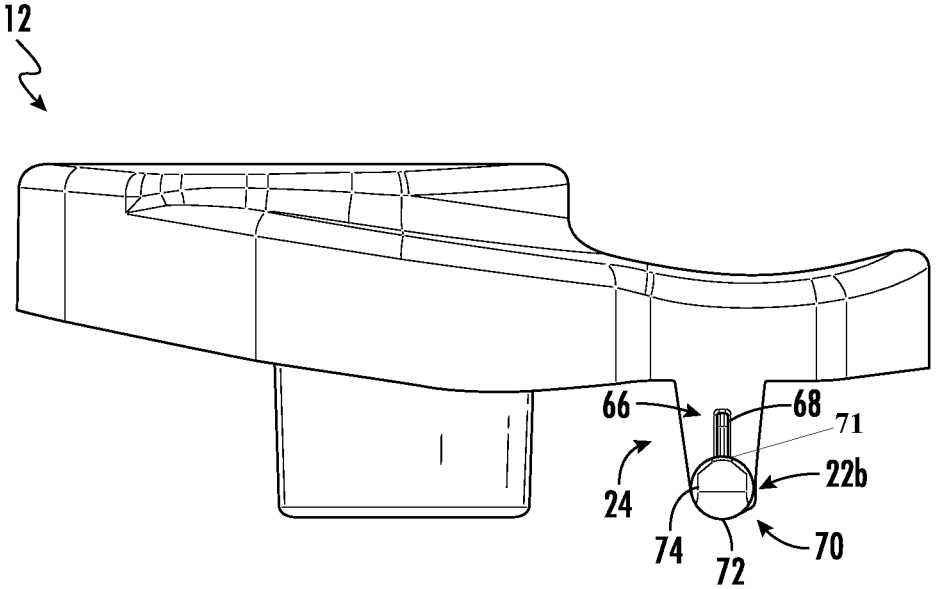
FIG. 5A is a side cross-sectional view of the closure of FIG. 1 taken along line 5*a*-5*a* shown in FIG. 4A, according to an exemplary embodiment.
Figure 5B:
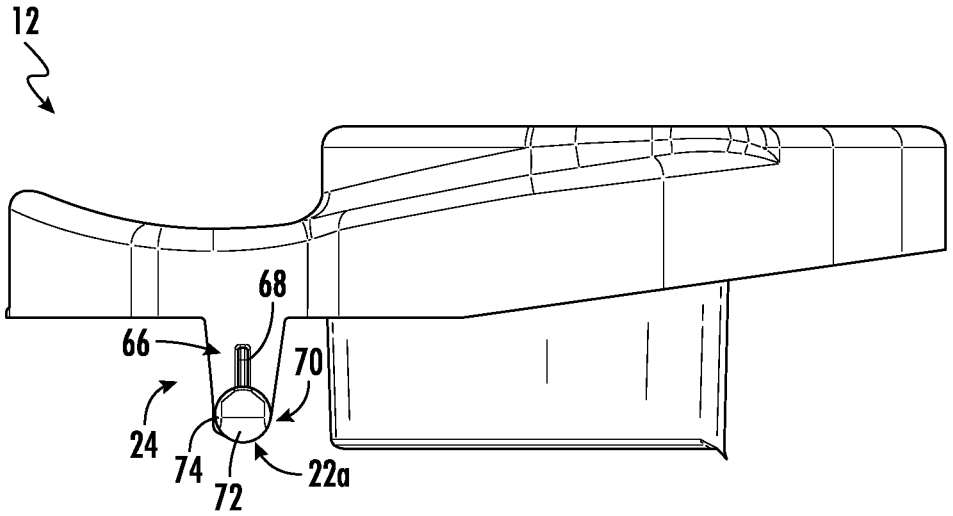
FIG. 5B is a side cross-sectional view of the closure of FIG. 1 taken along line 5*b*-5*b* shown in FIG. 4A, according to an exemplary embodiment.

Referring to FIGS. 5A-5B, side cross-sectional views of pivoting closure cap 12 taken along line 5*a*-5*a* and line 5*b*-5*b* are shown. Hinge assemblies 22*a*, 22*b* each include an anti-removal component, shown as tab 71. Tab 71 extends from the distal end of truncated hinge pin 70 toward the top end 27 of the support member 24. The tab 71 engages the respective hinge pin socket 37 to retain the hinge pin 70 within the socket 37 while the pivoting closure cap 12 simultaneously pivots and is lifted. Truncated hinge pin 70 includes an angled surface or pin bevel guide 72 at the bottom end of hinge pin 70. In some embodiments, truncated hinge pin 70 further includes an opposing pair of angled side surfaces 74 to further improve engagement with hinge pin receiver 26*a*, 26*b* during alignment and assembly of dispensing cap 10.

Each pin bevel guide 72 engages with a receiver top 52 to direct a hinge assembly 22*a* or 22*b* into a respective hinge pin socket 37. Receiver top 52 is positioned above hinge pin socket 37. Detent rib 66 has a beveled outer surface 68 configured to engage with detent groove 54 during alignment of hinge assembly 22 as pivoting closure cap 12 couples to closure base 14. In some embodiments, detent rib 66 includes beveled edges along the sides of detent rib 66 and extending in the longitudinal direction of detent rib 66. Detent rib 66 engages with detent groove 54 to direct each hinge assembly 22*a*, 22*b* into a respective hinge pin socket 37 during alignment and assembly of dispensing cap 10. When dispensing cap 10 is in a closed position, detent ribs 66 rest within detent grooves 54. When dispensing cap 10 is pivoted into an open position, detent ribs 66 pivot out of detent grooves 54 such that when dispensing cap is in an open position, detent ribs 66 rest outside detent grooves 54.

Figure 6:
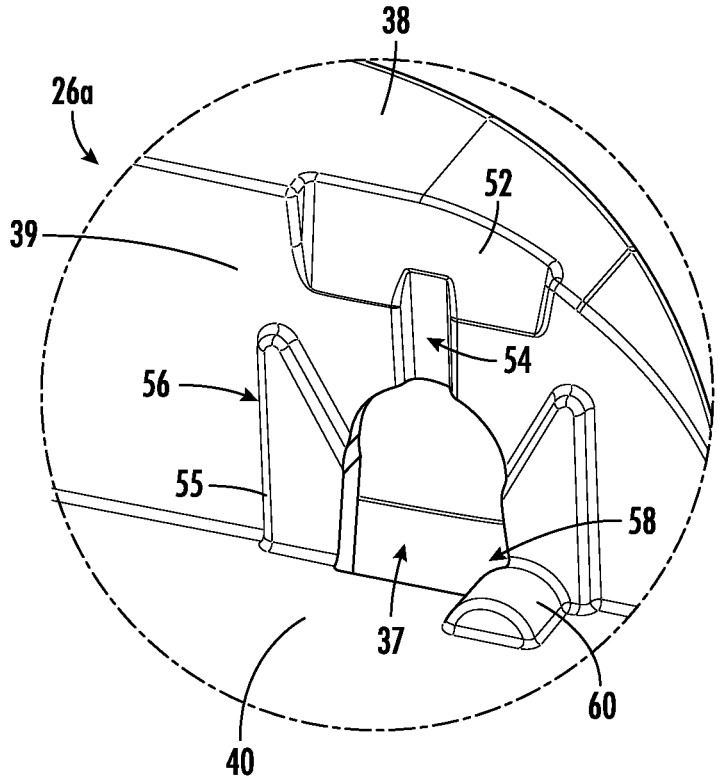
FIG. 6 is a top exploded view of the hinge pin receiver shown in FIGS. 2-3, according to an exemplary embodiment.
Figure 7:
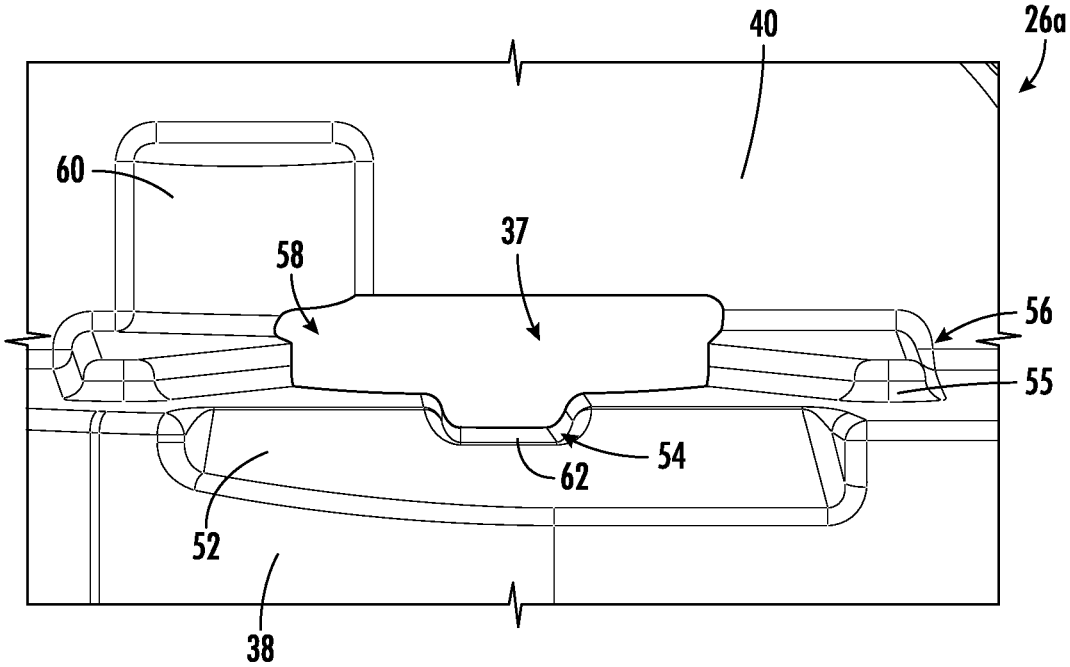
FIG. 7 is a top exploded view of the hinge pin receiver shown in FIGS. 2-3 and 5, according to an exemplary embodiment.

Referring to FIGS. 6-7 details of closure base 14 and hinge pin receiver 26*a* are shown. Hinge pin receiver 26*b* is positioned on the opposing side of closure base 14 from hinge pin receiver 26*a*. Hinge pin receiver 26*a* receives hinge assembly 22*a* and hinge pin receiver 26*b* receives hinge assembly 22*b*. Dispensing cap 10, and specifically closure base 14 includes the elongated hinge pin sockets 37 defined within and extending through the inner surface 39 of wall 15 on opposing sides of closure base 14. Each hinge pin socket 37 extends through inner surface 39 of wall 15 and provides increased resistance to removal for hinge assemblies 22*a*, 22*b* within hinge pin socket 37 because it is harder to remove hinge assemblies 22*a*, 22*b* from hinge pin socket 37 when compared to the indentation used in many other closures. In some embodiments, hinge pin socket 37 is produced using a slide during injection molding.

Hinge pin receiver 26*a* includes a receiver top 52 and a receiver bottom. Hinge pin receiver 26 includes an elongated hinge pin socket 37 formed in the receiver proximate the receiver bottom and further includes the detent groove 54 extending from the pin socket 37 toward the receiver top. The hinge pin 70 is located and rotatable within the hinge pin socket 37.

The components of the hinge pin receivers 26*a*, 26*b* discussed herein, allow for improved accuracy during coupling or assembly of dispensing cap 10 and specifically hinge assemblies 22*a*, 22*b* and hinge pin sockets 37. Without the guidance, many closures have problems reliably placing the pin for coupling during assembly. The problems can be related to shrinkage and distortion that are avoided by the design discussed herein.

Hinge pin receiver 26 further includes a pair of tapered pin guides or ears 56. A first tapered pin guide 56 extends from the receiver bottom toward the receiver top along one side of the pin socket. A second tapered pin guide 56 extends from the receiver bottom toward the receiver top along the other side of the pin socket 37 to facilitate engagement of the hinge pins 70 with the hinge pin sockets 37.

In some embodiments, pin guides 56 include a beveled outer edge 55. The pin guides define an angle between the portions of outer edge 55. In other embodiments, the outer edge of pin guides 56 may only be beveled on one side or not beveled at all.

Receiver top 52 acts as guide ramp and is positioned above hinge pin socket 37 and angled such that the inner surface 39 of wall 15 is connected to upward facing surface 38 of wall 15. Detent groove 54 includes an inner groove surface 62 shaped and configured to receive detent rib 66 and maintain the position of hinge assemblies 22*a*, 22*b* when dispensing cap 10 is in the closed position. In some embodiments, detent groove 54 includes beveled edges along the sides of detent groove 54 extending in the longitudinal direction of detent groove 54.

Hinge pin receiver 26 further includes a projection, shown as cam surface 60 located on horizontal, upward facing surface 40 that defines the receiver bottom. Cam surface 60 is positioned at the bottom of hinge pin receivers 26*a*, 26*b* along the receiver bottom. Cam surface 60 and pin guide 56 partially define an opening 58 connected to hinge pin socket 37 such that hinge pin socket 37 is not symmetrical. Opening 58 allows for some interference between cam surface 60 and pin guide 56 to resist the hinge assembly movement without providing so much resistance that dispensing cap 10 would be prevented from opening.

Figure 8:
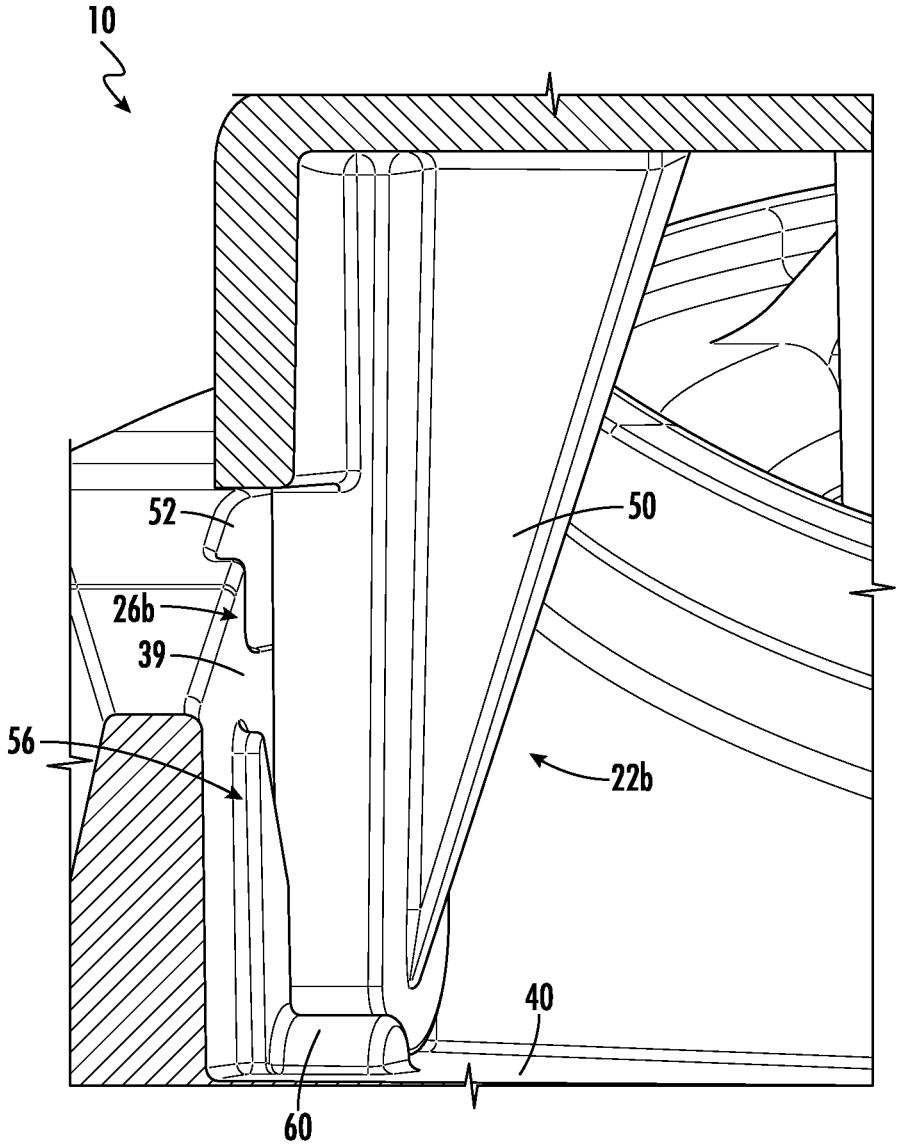
FIG. 8 is a detailed perspective view of the closure of FIG. 1, in a second, closed position, according to an exemplary embodiment.
Figure 9:
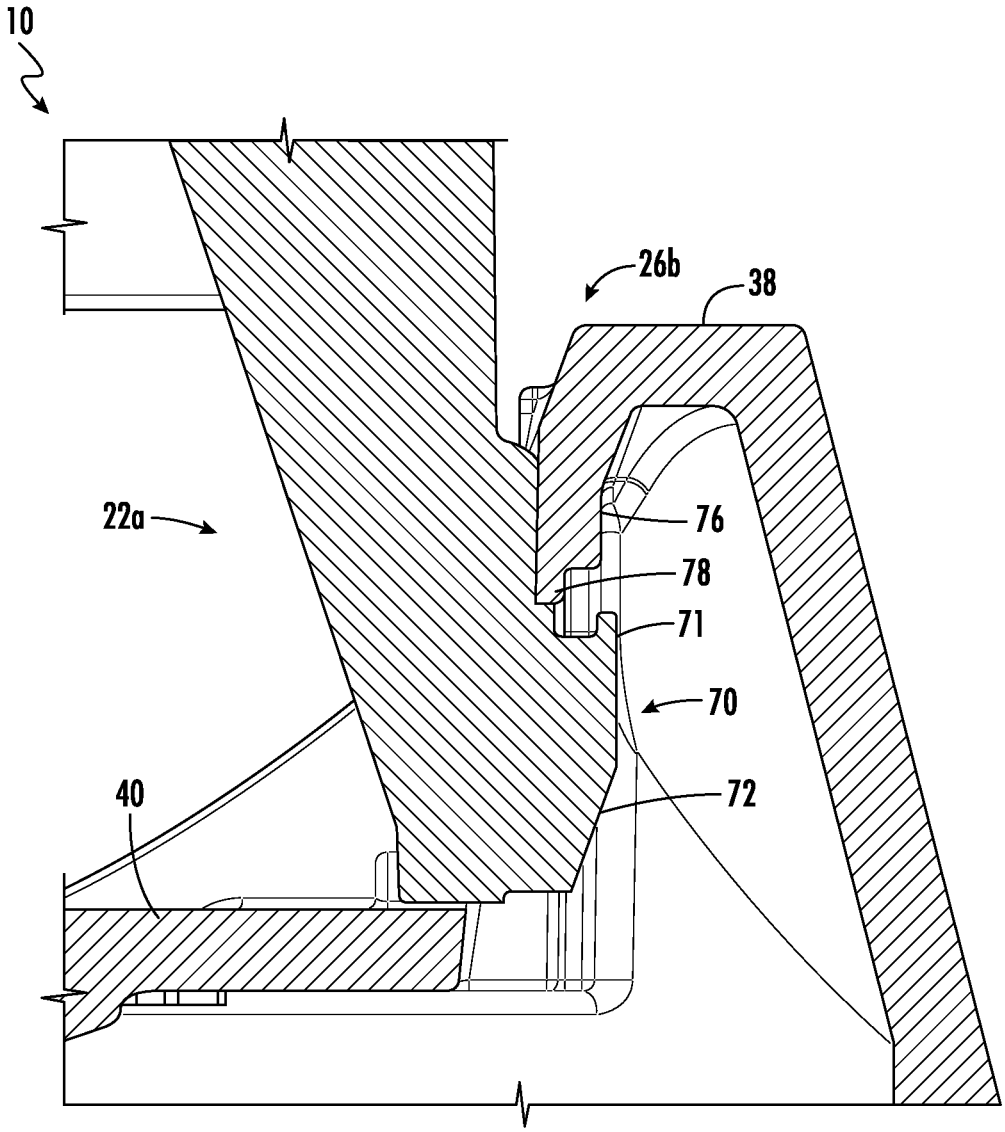
FIG. 9 is a detailed cross-section view of the closure of FIG. 1, in the second, closed position, according to an exemplary embodiment.
Figure 10:
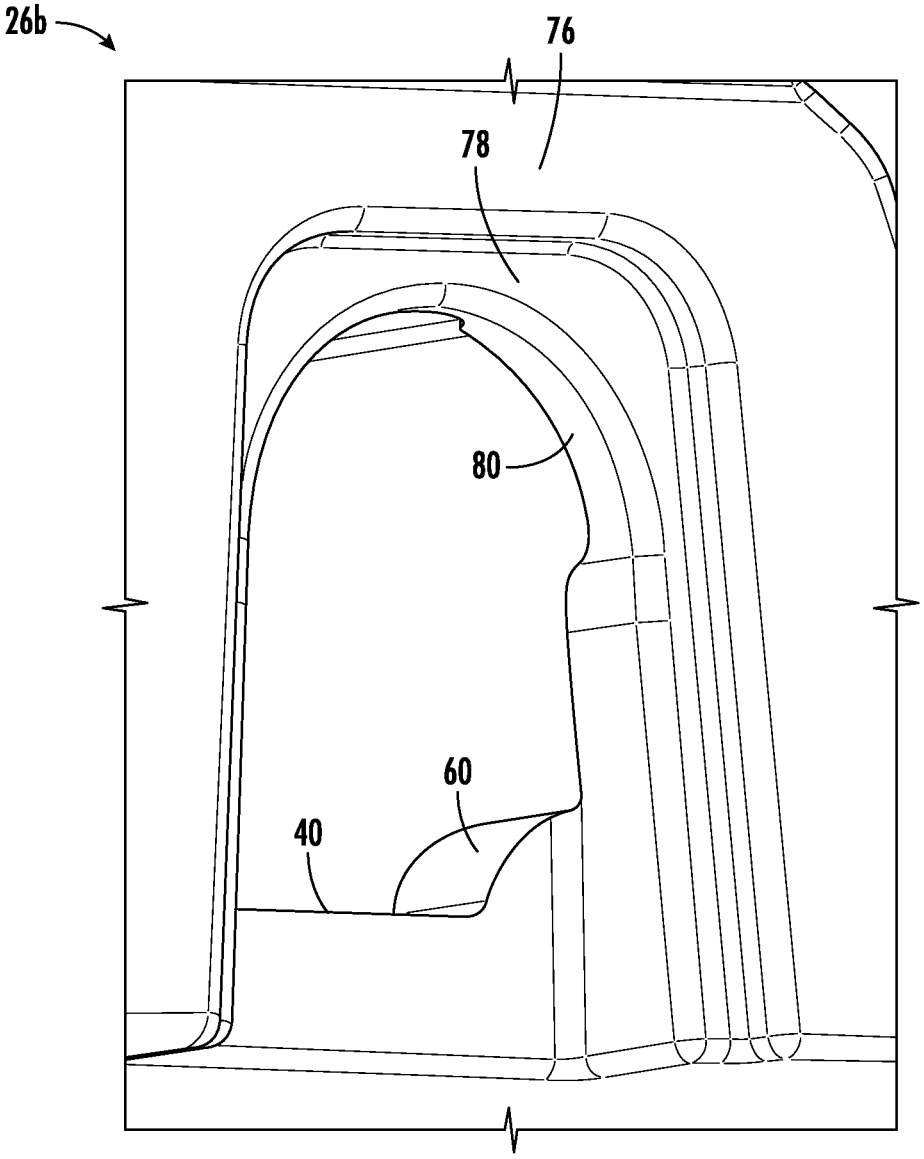
FIG. 10 is a detailed rear perspective view of the hinge pin receiver of FIG. 6, according to an exemplary embodiment.

Referring to FIGS. 8-9 provide detailed views of hinge assembly 22*b* when dispensing cap 10 is in a closed position with hinge assembly 22*b* extending through hinge pin socket 37 as shown. As discussed previously, receiver top 52 and detent groove 54 help to align hinge assembly 22 and maintain the position of hinge assembly 22*b* through friction so the distal end including truncated hinge pin 70 can be received within hinge pin socket 37 and so that hinge assembly 22*b* maintains positioning within hinge pin socket 37 during pivoting.

Truncated hinge pin 70 extends within hinge pin socket 37 beyond a stepped portion 78 of wall 15 and past the internal surface 76 of wall 15. The positioning of truncated hinge pin 70 helps to resist removal of hinge assembly 22 from the coupled or locked position. As shown in FIG. 9, anti-removal tab 71 is positioned to engage with stepped portion 78 of wall 15 to resist removal of hinge assembly 22*a* from hinge pin socket 37. As hinge assembly 22*a* pivots and lifts, tab 71 continues to interfere with stepped portion 78 and internal surface 76.

As mentioned above, when push pad 20 is pressed, hinge assemblies 22*a*, 22*b* are configured to pivot. When a user presses push pad 20 with enough force to overcome the interference between the hinge assemblies 22*a*, 22*b* and the hinge pin receivers 26*a*, 26*b*, the detent rib 66 pivots out of detent groove 54, opening dispensing cap 10 for use. Hinge assemblies 22*a*, 22*b* and pivoting closure cap 12 pivot to an angle between 30° and 40° and more specifically about 35° (e.g., 35° plus or minus 2°).

Referring to FIG. 12, a detailed view of the internal structures of wall 15 are shown. As previously discussed, truncated hinge pin 70 and anti-removal tab 71 extend beyond the stepped portion 78 and internal surface 76 of wall 15 when pivoting closure cap 12 is coupled to closure base 14 to resist removal of hinge assembly 22*b* from hinge pin socket 37.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A closure comprising:

a pivoting closure cap comprising an upper surface and a lower surface;

a hinge assembly extending downward from the pivoting closure cap, the hinge assembly comprising:

a support member extending between a top end connected to the cap and a bottom end;

a truncated hinge pin coupled to the support member at the bottom end; and a detent rib extending upwardly from the pin toward the top end; and a closure base comprising:

a hinge pin receiver having a receiver top and a receiver bottom, the hinge pin receiver comprising:

an elongated hinge pin socket formed in the receiver proximate the receiver bottom;

a detent groove extending from the pin socket toward the receiver top, the hinge pin being positioned and rotatable within the socket; and a cam surface located at the receiver bottom and adjacent to the socket, the bottom end of the hinge assembly bearing against the cam surface such that when the closure cap is pivoted open, the closure cap is simultaneously lifted during pivoting.

2. The closure of claim 1, wherein the hinge pin comprises a tab extending from a distal end of the hinge pin toward the top end of the support member, the tab engaging the hinge pin socket to retain the hinge pin within the socket while the closure cap is pivoted and simultaneously lifted.

3. The closure of claim 1, wherein the closure cap pivots relative to the closure base between a closed position in which the detent rib rests within the detent groove and an open position in which the detent rib rests outside of the detent groove.

4. The closure of claim 1, wherein the pivoting closure further comprises a second hinge assembly, the second hinge assembly comprising a second truncated hinge pin, the truncated hinge pins having the same rotational axis, and wherein the closure base further comprises a second hinge pin receiver for receiving the second hinge pin.

5. The closure of claim 4, wherein the hinge pin receivers are positioned on opposing inner surfaces of the closure base.

6. The closure of claim 1, wherein the hinge pin receiver further includes a first tapered pin guide extending from the receiver bottom toward the receiver top along one side of the pin socket to facilitate engagement of the hinge pin with the hinge pin socket.

7. A closure comprising:

a pivoting closure cap including an upper surface and a lower surface;

a pair of hinge assemblies extending downward from opposing sides of the pivoting closure cap and having the same rotational axis, each hinge assembly comprising:

a support member including a top end connected to the cap and extending to a bottom end;

a truncated hinge pin extending outward from the support member at the bottom end; and a detent rib extending upwardly from the hinge pin toward the top end; and a closure base comprising:

an opposing pair of hinge pin receivers, each hinge pin receiver including a receiver top and a receiver bottom, each hinge pin receiver comprising:

a hinge pin socket extending through an inner wall of the closure base and formed in the receiver proximate the receiver bottom; and a detent groove extending toward the receiver top, the hinge pins being positioned and rotatable within the sockets.

8. The closure of claim 7, wherein the closure cap pivots relative to the closure base between a closed position in which the detent ribs rest within the detent grooves and an open position in which the detent ribs rest outside of the detent grooves.

9. The closure of claim 8, wherein the pivoting closure includes a push pad and pivots from the closed position to the open position when a force is applied to the push pad, the force being of a magnitude to move the detent ribs from within the detent grooves.

10. The closure of claim 7, wherein the truncated hinge pin extends in a generally perpendicular orientation to the support member.

11. The closure of claim 7, wherein the truncated hinge pin further comprises:

an angled pin bevel guide at a bottom end of the hinge pin; and an opposing pair of angled side surfaces to facilitate engagement of the hinge pin with the hinge pin socket.

12. The closure of claim 7, the pair of hinge pin receiver further including a pair of cam surfaces located at the receiver bottom and adjacent to the hinge pin sockets, the bottom end of the hinge assemblies bearing against the cam surfaces such that when the closure cap is pivoted open, the closure cap is simultaneously lifted during pivoting.

13. The closure of claim 7, the pivoting closure cap further including a cylindrical cap plug extending downward from a lower surface and the closure base further defining a fluid channel, wherein the cylindrical cap plug rests within the fluid channel when the closure is in a closed position.

14. The closure of claim 13, wherein a lift provided to the closure cap during pivoting moves the cylindrical cap plug out of the fluid channel when the closure is in an open position such that a fluid can travel through the fluid channel.

15. The closure of claim 7, wherein the pair of hinge pins each include a tab extending from a distal end of the hinge pin toward the top end of the support member, the tabs engaging the respective hinge pin sockets to retain the pair of hinge pins within the sockets when the closure cap is pivoted.

16. A closure comprising:

a pivoting closure cap including an upper surface and a lower surface;

a pair of hinge assemblies extending downward from opposing sides of the pivoting closure cap and having the same rotational axis, each hinge assembly comprising:

a support member including a top end connected to the cap and extending to a bottom end;

a hinge pin extending generally perpendicular to the support member; and a detent rib extending upwardly from the pin toward the top end of the support member;

a closure base comprising:

an opposing pair of hinge pin receivers, each hinge pin receiver comprising:

a receiver top; a receiver bottom;

an elongated hinge pin socket formed in the receiver proximate the receiver bottom; and a pair of cam surfaces located at the receiver bottom and adjacent to the hinge pin sockets, the bottom end of the hinge assemblies bearing against the cam surfaces when the closure cap is pivoted open.

17. The closure of claim 16 further comprising:

a cylindrical cap plug extending downward from the lower surface of the pivoting closure cap;

a fluid channel defined within the closure base and positioned such that the cylindrical cap plug rests within the fluid channel when the closure is in a closed position; and a pour spout formed in the closure base, the pour spout positioned at least partially around and extending upward from the fluid channel.

18. The closure of claim 17, wherein a lift provided to the closure cap during pivoting lifts the cylindrical cap plug out of the fluid channel when the closure is in an open position such that a fluid can travel through the fluid channel and pour from the spout.

19. The closure of claim 17, the closure base further including a barrier wall extending upward, toward the pivoting closure cap, wherein the hinge pin receivers are positioned between the fluid channel and the barrier wall.

20. The closure of claim 16, wherein the hinge pin receivers further include a first tapered pin guide extending from the receiver bottom toward the receiver top along one side of the pin socket and a second tapered pin guide extending from the receiver bottom toward the receiver top along the other side of the pin socket to facilitate engagement of the hinge pins with the hinge pin sockets.

* * * * *